United States Patent [19]

Ortiz

[11] Patent Number: 4,881,879

[45] Date of Patent: Nov. 21, 1989

[54] ROTARY COMPRESSOR GAS ROUTING FOR MUFFLER SYSTEM

[75] Inventor: Arturo L. Ortiz, Tecumseh, Mich.

[73] Assignee: Tecumseh Products Company, Tecumseh, Mich.

[21] Appl. No.: 319,924

[22] Filed: Mar. 6, 1989

Related U.S. Application Data

[63] Continuation of Ser. No. 138,365, Dec. 24, 1987, abandoned.

[51] Int. Cl.[4] ..... F04B 39/00

[52] U.S. Cl. ..... 417/312; 417/902; 417/313; 418/63; 418/181

[58] Field of Search ..... 417/312, 313, 410, 902; 418/63, 181; 62/296

[56] References Cited

U.S. PATENT DOCUMENTS

| | | | |
|---|---|---|---|
| 2,764,342 | 9/1956 | Dills | 418/181 |
| 3,003,684 | 10/1957 | Tarleton | 417/902 X |
| 3,016,183 | 1/1962 | Murphy et al. | 418/63 |
| 3,031,861 | 5/1962 | McCormack | 417/902 X |
| 3,130,902 | 4/1964 | Brown | 418/63 |
| 3,270,955 | 9/1966 | Huyser et al. | 418/181 |
| 4,088,428 | 5/1978 | Bannister et al. | 418/270 |
| 4,355,963 | 10/1982 | Tanaka et al. | 418/63 |
| 4,391,573 | 7/1983 | Tanaka et al. | 418/63 |
| 4,427,351 | 1/1984 | Sano | 418/63 |
| 4,457,671 | 7/1984 | Watanbe | 417/312 |
| 4,518,330 | 5/1985 | Asami et al. | 418/63 |
| 4,569,645 | 2/1986 | Asami et al. | 418/63 |
| 4,573,879 | 3/1986 | Uetuji et al. | 417/312 |
| 4,623,304 | 11/1986 | Chikada et al. | 417/312 |
| 4,645,429 | 2/1987 | Asami et al. | 417/312 |
| 4,730,996 | 3/1988 | Akatsuchi et al. | 417/312 X |

FOREIGN PATENT DOCUMENTS

| | | | |
|---|---|---|---|
| 153795 | 9/1982 | Japan | 418/181 |
| 128994 | 7/1985 | Japan | 418/181 |
| 241470 | 10/1986 | Japan | 417/313 |
| 250394 | 11/1986 | Japan | 418/63 |
| 279794 | 12/1986 | Japan | 418/181 |

*Primary Examiner*—William L. Freeh
*Assistant Examiner*—Leonard P. Walnoha
*Attorney, Agent, or Firm*—Albert L. Jeffers; John F. Hoffman; David L. Ahlersmeyer

[57] ABSTRACT

A hermetically sealed rotary compressor is disclosed wherein gas compressed within a compression chamber defined by a cylinder block is discharged through respective discharge ports in the main and outboard bearings defining the ends of the cylinder. Mufflers are provided on the outside ends of the bearings into which the compressed gas is expanded. A constricting gas passageway extending through the bearings and the cylinder block provides a path for constricted flow of gas from one muffler to the other. The constricted gas expands upon entry into the other muffler, thereby providing a cooler recombined discharge gas for use in cooling oil in the oil sump and cooling the motor stator windings.

18 Claims, 3 Drawing Sheets

ROTARY COMPRESSOR GAS ROUTING FOR MUFFLER SYSTEM

This is a continuation of application Ser. No. 138,365, filed Dec. 24, 1987 now abandoned.

BACKGROUND OF THE INVENTION

This invention pertains to rotary compressors for compressing refrigerant in refrigeration systems such as air conditioners, refrigerators, and the like. In particular, the invention relates to discharge gas routing systems for such compressors to reduce noise pulsations and to provide cooler discharge gas.

In general, prior art hermetic rotary compressors comprise a housing which is hermetically sealed. Located in the housing are an electric motor and a compressor mechanism. The electric motor is connected to a crankshaft which has an eccentric portion thereon. The eccentric portion of the crankshaft is located within a compression chamber bore of the compressor cylinder block. A roller located within the compression chamber is mounted on the eccentric portion of the crankshaft and is driven thereby. The roller cooperates with a sliding vane to compress refrigerant within the bore of the cylinder block.

Rotary hermetic compressors of the type herein disclosed generally have a pressurized or high side sealed housing. Compressed gas from within the compression chamber is discharged through a gas routing system into the compressor housing. This discharge gas exhibits undesirable properties with respect to achieving quiet and efficient operation of the compressor. Specifically, noise pulsations are ordinarily caused by the discharge gas due to opening and closing of valving in response to the cyclical compression and suction created in the compression chamber within the cylinder block. Under certain operating conditions, and particularly for higher capacity compressors, these noise pulsations become objectionable to the consumer. Another problem associated with rotary hermetic compressors, wherein pressurized gas is discharged into the sealed housing, is a hot operating environment which tends to decrease the efficiency of the electric motor. High operating temperatures also result in undesirable high temperatures for the lubricating oil, the housing, and the discharge gas.

Prior art gas routing systems for rotary compressors have generally addressed the problem of excessive noise pulsations by providing a single discharge port in either of the main or outboard bearings through which compressed gas is removed from the compression chamber into a muffler or a series of mufflers. In several prior art gas routing systems, after the compressed gas is discharged through a bearing into a muffler cavity, it is rerouted through passageways extending through both bearings and the cylinder block and then through an auxiliary muffler system or directly into the housing.

Another prior art gas routing system provides for multiple discharge ports in the sidewall of the cylindrical compression chamber providing communication between the compression chamber and a discharge chamber defined within the cylinder block. From the discharge chamber, discharge gas passes through a single port extending through a bearing into a muffler before being discharged into the interior of the compressor housing. By providing a plurality of discharge ports in the sidewall of the compression chamber, cooler gas is discharged into the discharge chamber defined within the cylinder block. The gas is then recompressed and discharged through a single smaller opening in one of the bearings.

A disadvantage of the prior art solutions wherein compressed gas is discharged through a single opening in one of the main or outboard bearings is that a single opening in a rotary compressor cannot be made large enough to sufficiently reduce the level of noise pulsations. Furthermore, the temperature of gas discharged through a limited size opening is hotter than can otherwise be achieved though larger openings, thus increasing operating temperatures of the compressor and reducing compressor efficiency.

The prior art rotary compressor design utilizing a plurality of discharge ports in the sidewall of the cylinder provides a baffling chamber in the cylinder block. However, the discharge gas is ultimately discharged through one port in one of the bearings into a single muffler, thereby maintaining objectionable sound pulsations. A further problem with a rotary compressor having a discharge chamber defined within the cylinder block is that compressor size may be increased by the need for space surrounding the compression chamber. Also, heat generated in the compression chamber and dissipated into the cylinder block maintains the discharge gas within the discharge chamber at higher temperatures, thereby decreasing its ability to cool compressor components when discharged within the housing.

It is also known in the art to provide a discharge muffler mounted on the outboard bearing in fluid communication with oil in the oil sump for the purpose of providing sound muffling. To this end, discharge gas may be discharged into the oil to cause cavitation and adherance of air bubbles to the discharge muffler for further sound muffling.

SUMMARY OF THE INVENTION

The present invention overcomes the disadvantages of the above-described prior art hermetic rotary compressors by providing an improved discharge gas routing system for discharging gas from within the compression chamber of the cylinder block to the interior of the sealed compressor housing.

Generally, the invention provides a rotary compressor comprising a cylinder block defining a cylinder, and a main bearing and an outboard bearing located on respective ends of the cylinder block enclosing the cylinder at each of its opposite ends. In accord with the present invention, compressed gas from within the cylinder is discharged through first and second discharge ports extending through the main and outboard bearings, respectively. Accordingly, flow of the compressed gas discharged from within the cylinder is divided between the first and second discharge ports.

More specifically, the invention provides, in one form thereof, a gas routing system for a rotary compressor wherein compressed gas from within the compression chamber in the cylinder block is discharged through respective ports in the main and outboard bearings into mufflers mounted on the outside of the main and outboard bearings. The discharge gas is expanded upon entering each of the mufflers, whereby cooling of the gas occurs. The expanded gas of one of the mufflers flows through a passageway extending through the main and outboard bearings and the cylinder block and is combined with the expanded discharge gas in the other muffler prior to being discharged into the interior of a hermetically sealed housing.

An advantage of the structure of the present invention is that compressed gas from within the compression chamber can be discharged axially outwardly through both the main and outboard bearings, thereby increasing the effective size of the discharge port previously provided in only one of the main or outboard bearings. This results in noise pulsations of a lesser magnitude and discharge gas at lower temperatures.

Another advantage of the gas routing system for rotary compressors of the present invention is that gas expanded into one muffler may be recompressed by flowing through a constricting passageway to the other muffler, whereupon the constricted gas flow is reexpanded and combined with the discharge gas in the other muffler. This gas that is expanded, recompressed, and reexpanded is cooler than gas discharged directly into the other muffler. Additionally, the routing of gas into one muffler and through a constricting passageway into the other muffler provides additional baffling to reduce noise pulsations.

A still further advantage of the rotary compressor gas routing system in accordance with the present invention is that gas discharged through both the main and outboard bearings into separate mufflers and then combined into one of the mufflers is cooler than gas that would ordinarily be discharged directly into a single muffler. The muffler in which the cooler gas is combined may be in direct fluid communication with the oil in the oil sump of the compressor housing, thereby providing greater cooling of the oil than is ordinarily achievable.

Yet another advantage of the gas routing system according to the present invention is that flow of the combined discharge gas exhibiting a cooler temperature may be directed at the stator windings of the electric motor in order to provide better cooling and more efficient operation thereof. Also, the cooler discharge gas directed for cooling the stator windings contributes to an overall cooler temperature within the sealed compressor housing.

Yet another advantage of the structure of the present invention, in one form thereof, is that the passageways provided between the compression chamber and the mufflers, between the two mufflers, and between one of the mufflers and the interior of the compresssor housing are comprised of substantially aligned holes through the main and outboard bearings and the cylinder block, whereby the mufflers do not require tubing connections, thus contributing to ease and lower costs of manufacturing. Furthermore, the plurality of holes extending through the main and outboard bearings and the cylinder block reduce the mass of the cylinder and bearings and require no additional tubing.

The paramount advantages of the gas routing system in accordance with the present invention are reduced sound levels achieved through the axial discharge of compressed gas through both of the bearings, and improved efficiency due to lower operating temperatures within the compressor housing, including lower oil temperatures, lower stator winding temperatures, etc.

The rotary compressor of the present invention, in one form thereof, provides a cylinder block defining a cylinder, and a main bearing and an outboard bearing located on respective ends of the cylinder block to close the cylinder at each of its opposite ends. An eccentric roller is rotationally mounted in the cylinder, whereby rotation of the roller in the cylinder results in compressed gas within the cylinder. A rotatable crankshaft is operably supported by the main and outboard bearings and is drivingly connected to the roller for rotation thereof. Means for discharging the compressed gas from within the cylinder is provided, comprising a first discharge port in communication with and extending from the cylinder through the main bearing and a second discharge port in communication with and extending from the cylinder through the outboard bearing. Accordingly, flow of the compressed gas discharge from within the cylinder is divided between the first and second discharge ports.

There is further provided, in one form of the present invention, a hermetic rotary compressor having a housing, an electric motor operatively disposed within the housing and including a rotatable rotor, and a cylinder block disposed within the housing in axial alignment with the rotor, the cylinder block defining a cylinder therein. A main bearing is located on the end of the cylinder block adjacent to the motor, and closes the respective end of the cylinder. An outboard bearing is located on the end of the cylinder block opposite of the motor, and closes the respective end of the cylinder. A crankshaft is rotatably connected to the rotor and is operably supported by the main and outboard bearings. Eccentric roller means within the cylinder and operably connected to the crankshaft compresses gas within the cylinder. Additionally, means for discharging compressed gas from within the cylinder axially outwardly in both axial directions is provided. The discharging means comprises a first discharge port communicating with the cylinder and extending through the main bearing, and a second discharge port communicating with the cylinder and extending through the outboard bearing.

The rotary hermetic compressor of the instant invention further provides, in one form thereof, a vertically disposed hermetically sealed cylindrical casing. An electric motor unit is mounted within the casing and includes a rotatable rotor and a stator. The hermetic compressor also includes an oil sump located in a lower portion of the housing and a cylinder block having a compression chamber defined therein. An upper bearing is mounted to the upper end of the cylinder and defines an upper end wall of the chamber. The upper bearing has an upper discharge port extending therethrough. A lower bearing is mounted to the lower end of the cylinder block and defines a lower end wall of the compression chamber. The lower bearing has a lower discharge port extending therethrough. A crankshaft is drivingly connected to the rotor and operably supported by the upper and lower bearings. Piston means for compressing gas within the chamber is drivingly connected to the crankshaft. An upper muffler is mounted to the top of the upper bearing, whereby the upper discharge port provides gaseous communication between the chamber and the upper muffler. A lower muffler is mounted to the bottom of the lower bearing and is in fluid contact with oil in the oil sump. The lower discharge port provides gaseous communication between the chamber and the lower muffler, whereby compressed gas from within the chamber is discharged and expanded into the upper and lower mufflers. Additionally, the compressor of this form may provide constricting gas passage means communicating between the upper and lower mufflers for constricting expanded discharge gas from the upper muffler and delivering it to the lower muffler for reexpansion therein. The lower muffler then communicates with the inside of the housing by means of discharge gas passage means for constricting the expanded discharge gas from the lower muffler and delivering it to the inside of the inside of the housing in an upward direction toward the motor for cooling thereof.

DESCRIPTION OF THE PREFERRED EMBODIMENT

Figure 1:
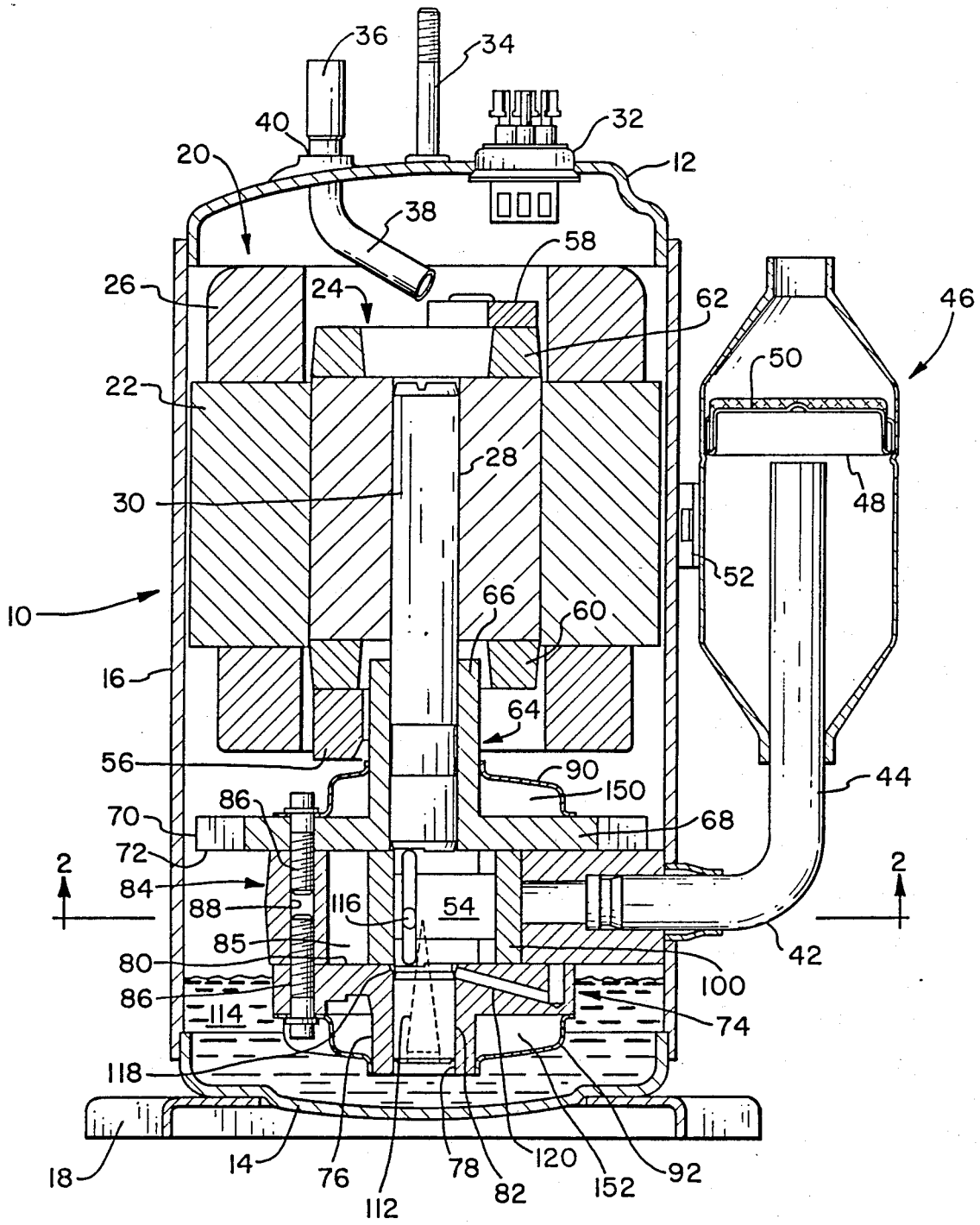
FIG. 1 is a side sectional view of a rotary compressor of the type to which the present invention pertains.

In an exemplary embodiment of the invention as shown in the drawings, and in particular by referring to FIG. 1, a compressor is shown having a housing generally designated at 10. The housing has a top portion 12, a lower portion 14 and a central portion 16. The three housing portions are hermetically secured together as by welding or brazing. A flange 18 is welded to the bottom of housing 10 for mounting the compressor. Located inside the hermetically sealed housing is a motor generally designated at 20 having a stator 22 and a rotor 24. The stator is provided with windings 26. The stator is secured to the housing 10 by an interference fit such as by shrink fitting. The rotor 24 has a central aperture 28 provided therein into which is secured a crankshaft 30 by an interference fit. A terminal cluster 32 is provided on the top portion 12 of the compressor for connecting the compressor to a source of electric power. A post 34 is welded to top portion 12 for mounting a protective cover (not shown) for terminal cluster 32.

A refrigerant discharge tube 36 extends through top portion 12 of the housing and has an end 38 thereof extending into the interior of the compressor as shown. The tube is sealingly connected to housing 10 at 40 as by soldering. Similarly, a suction tube 42 extends into the interior of compressor housing 10 and is sealed thereto as by soldering, brazing, or welding. The outer end 44 of suction tube 42 is connected to accumulator 46 which has support plates 48 disposed therein for supporting a filtering mesh 50. A bracket 52 secures accumulator 46 to the outside wall of housing 10.

Figure 2:
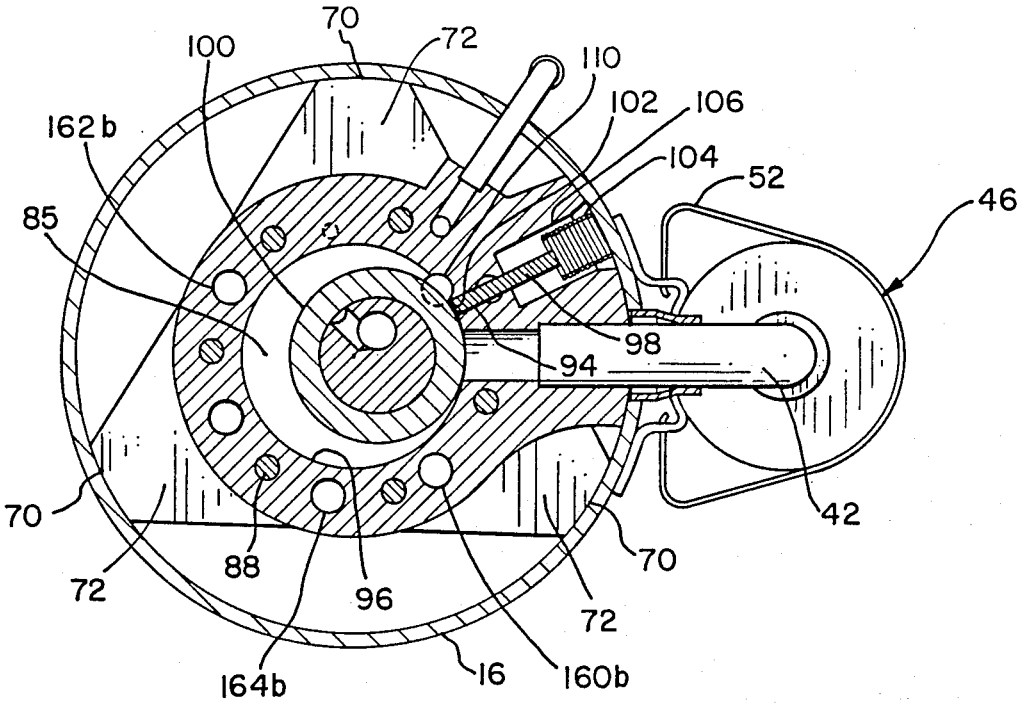
FIG. 2 is a sectional view of the compressor of FIG. 1 taken along line 2—2 of FIG. 1 and viewed in the direction of the arrows.
Figure 3:
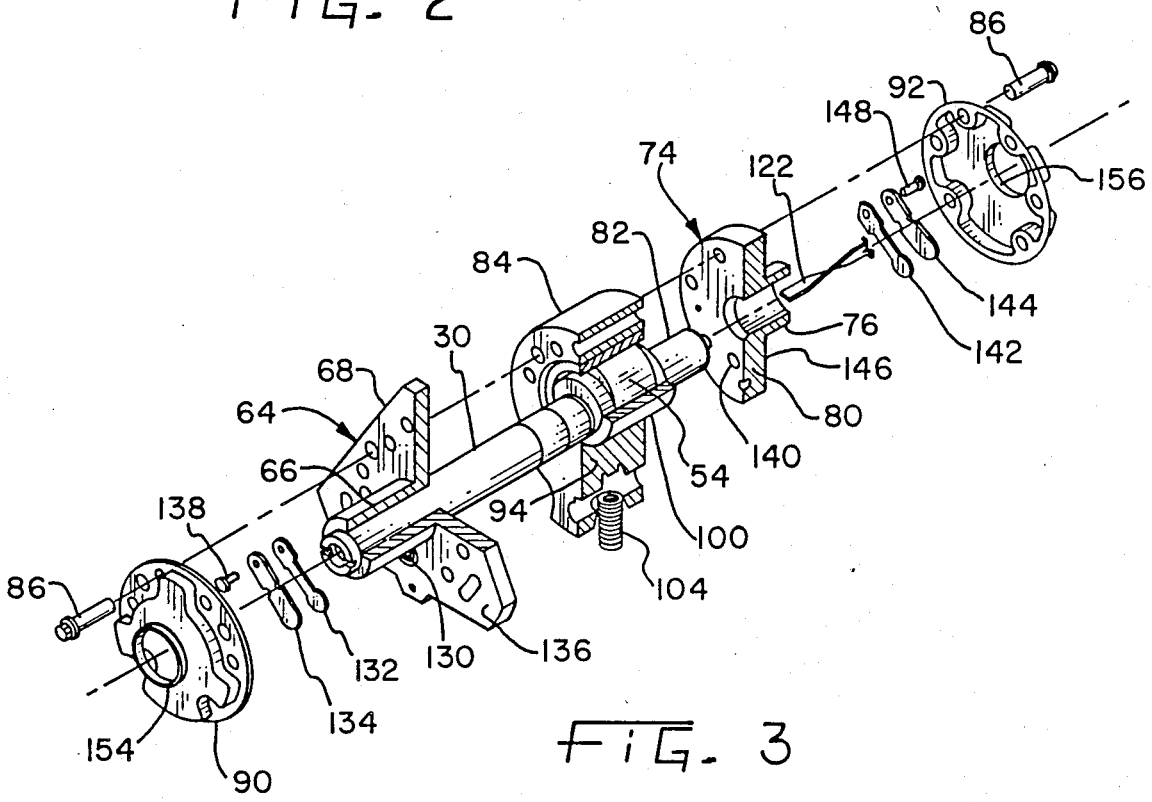
FIG. 3 is an exploded perspective view of the compressor mechanism of the rotary compressor assembly of FIG. 1, particularly showing the axial assembly of the various compressor mechanism components.

By referring specifically to FIGS. 1 and 3, it can be seen that crankshaft 30 is provided with an eccentric portion 54 which revolves around the crankshaft axis as crankshaft 30 is rotatably driven by rotor 24. Counterweights 56 and 58 are provided to balance eccentric 54 and are secured to respective end rings 60 and 62 of rotor 24 by riveting. Crankshaft 30 is journalled in a main bearing 64 having a cylindrical journal portion 66 and a generally flat planar mounting portion 68. Planar portion 68 is secured to housing 10 at three points 70 such as by welding of flanges 72 to the housing, as best illustrated in FIG. 2.

A second bearing or journal 74, sometimes referred to as the outboard bearing, is also shown disposed in the lower part of housing 10. Outboard bearing 74 is provided with a journal portion 76 having aperture 78 therein and a generally planar portion 80. Crankshaft 30 has a lower portion 82 journalled in journal portion 76 of outboard bearing 74 as illustrated in FIG. 1.

Located intermediate main bearing 64 and outboard bearing 74 is a compressor cylinder block 84. Cylinder block 84 defines a cylinder therein, referred to herein as compression chamber 85. Compressor cylinder block 84, outboard bearing 74, and main bearing 64 are secured together by means of twelve bolts 86, two of which are indicated in FIG. 1. By referring to FIG. 2, it can be seen that six threaded holes 88 are provided in cylinder block 84 for securing bearings 64, 74 and cylinder block 84 together. Of the twelve bolts 86, six of them secure outboard bearing 74 to cylinder block 84 and are threaded into holes 88. The remaining six bolts secure main bearing 64 to cylinder block 84 and are also threaded into holes 88. An upper discharge muffler plate 90 is secured to main bearing 64 and a lower discharge muffler plate 92 is secured to outboard bearing 74 by bolts 86, as indicated in FIG. 1.

By referring to FIGS. 1 and 2 it can be seen that cylinder block 84 has a vane slot 94 provided in the cylindrical side wall 96 thereof into which is received a sliding vane 98. Roller 100 is provided which surrounds eccentric portion 54 of crankshaft 30 and revolves around the axis of crankshaft 30 and is driven by eccentric 54. Tip 102 of sliding vane 98 is in continuous engagement with roller 100 as vane 98 is urged against the roller by spring 104 received in spring pocket 106. Referring to FIG. 2, during operation, as roller 100 rolls around compression chamber 85, refrigerant will enter chamber 85 through suction tube 42. Next, the compression volume enclosed by roller 100, cylinder wall 96, and sliding vane 98 will decrease in size as roller 100 revolves clockwise around compression chamber 85. Refrigerant contained in that volume will therefore be compressed and after compression will exit through a relief 110 in sidewall 96. The aforementioned compressor mechanism is presented by way of illustration only, it being contemplated that other piston means for compressing gas within chamber 85 may be used without departing from the spirit and scope of the present invention.

The rotary compressor disclosed herein provides a lubrication system for lubricating components of the compressor, including eccentric 54 and roller 100. Such a system is disclosed in U.S. Pat. No. 4,640,669, assigned to the same assignee as the present invention, the disclosure of which is hereby incorporated by reference. Referring to FIGS. 1 and 3, components of an exemplary lubrication system are shown, including aperture 112 in crankshaft 30 into which oil is drawn from oil in oil sump 114. Aperture 112 delivers oil to opening 116 in crankshaft 30 to lubricate roller 100. Oil also flows into annular chamber 118 and radially outwardly therefrom through passageway 120, as described more fully in U.S. Pat. No. 4,640,669. A conventional oil paddle 122 is axially mounted to end portion 82 of crankshaft 30 for contact with oil in oil sump 114.

Figure 4:
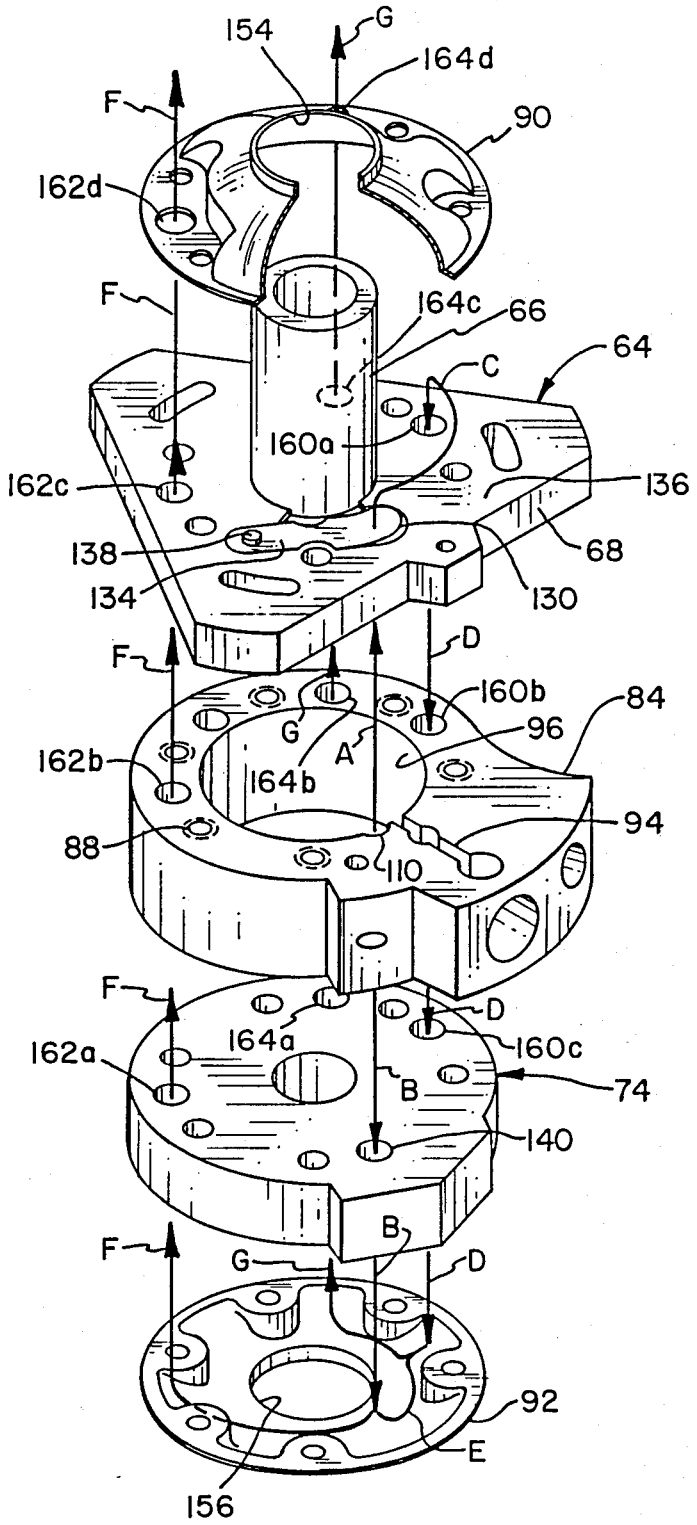
FIG. 4 is an exploded perspective view of the compressor mechanism of the rotary compressor assembly of FIG. 1, particularly showing the routing of gas compressed within the cylinder and eventually delivered to the interior of the compressor housing.

As best shown in FIGS. 3 and 4, the discharge gas routing system of the present invention provides means for discharging compressed gas from within chamber 85 and comprises a first discharge port 130 in communication with chamber 85 and extending through main bearing 64. A first discharge valve 132 and valve retainer 134 are mounted on outer surface 136 by means of a rivet 138. Likewise, a second discharge port 140 extends through outboard bearing 74. A second discharge valve 142 and valve retainer 144 are mounted on outer surface 146 by means of a rivet 148.

Compressed refrigerant gas which is discharged through relief 110 flows axially outwardly through discharge port 130 in the main bearing and discharge port 140 in the outboard bearing. Discharge of the compressed gas through discharge ports 130 and 140 occurs simultaneously when the two ports are axially aligned, as disclosed in the preferred embodiment. The gas is then discharged into first and second discharge mufflers comprising muffler chambers 150 and 152 defined by discharge muffler plates 90 and 92 and the outer surfaces 136 and 146 of bearings 64 and 74, respectively. In the preferred embodiment, a collar 154 is provided in muffler plate 90 to sealingly engage over journal portion 66 as by a slip-fit. Likewise, a collar 156 is provided in muffler plate 92 to sealingly engage over journal portion 76.

FIG. 4 illustrates the routing of discharge gas during operation of the compressor. More specifically, compressor refrigerant gas is discharged through relief 110 in cylinder block 84 and flows axially outwardly in opposite directions as illustrated by directional lines A and B. With respect to the vertical orientation of the compression mechanism in FIG. 4, the discharge gas indicated by line A flows through discharge port 130 in upper main bearing 64. Upon passing by discharge valve 132 and valve retainer 134, the discharge gas is expanded into upper muffler chamber 150 defined by muffler plate 90 and the top surface 136 of main bearing 64. The expansion of the discharge gas upon entry into muffler chamber 150 provides cooling of the discharge gas.

Discharge gas discharged axially downwardly as indicated by directional arrow B flows through discharge port 140 in lower outboard bearing 74 and passes through discharge valve 142 and valve retainer 144 before entering lower muffler chamber 152 defined by muffler plate 92 and outer surface 146 of outboard bearing 74. As the discharge gas is expanded into discharge space 152, a certain amount of cooling of the gas is achieved.

The present invention, in one form thereof, provides for the discharge gas in upper muffler chamber 150 to be routed into a constricting gas passageway 160, as indicated by directional arrow C. Constricting gas passageway 160 comprises holes **160*a* in main bearing 64, 160*b* in cylinder block 84, and 160*c* in outboard bearing 74. Holes 160*a*, 160*b*, and 160*c* are axially aligned to provide passageway 160, through which laminar flow of discharge gas is achieved, as indicated by directional arrow D. Constricting gas passageway 160 provides communication between muffler chambers 150 and 152** located at opposite ends of the compressor mechanism, and means for constricting discharge gas flowing therebetween.

As shown in FIG. 4, the discharge gas in muffler chamber 150 indicated by directional arrow C enters hole **160*a* in main bearing 64, proceeds through hole 160*b* in cylinder block 84, and finally passes through 160*c* in outboard bearing 74 before being expanded into discharge space 152. The expanded gas in muffler chamber 150 is recompressed during flow through passageway 160. Upon reexpansion into muffler chamber 152, the gas is once again cooled and combined with the gas discharged directly into chamber 152 through discharge port 140. The combined gas is cooler than would ordinarily be achieved by merely discharging all of the gas from compression chamber 85 through the outboard bearing into the lower muffler. More specifically, the gas discharged through main bearing 64 into discharge space 150 and then recompressed during flow through passageway 162 before entering discharge space 152, has undergone two stages of expansion and cooling. Also, the routing of gas through the upper muffler and then through passageway 60** prior to entering the lower muffler provides several additional stages of baffling to reduce sound.

When muffler plate 92 is in contact with the oil in oil sump 114, as illustrated in FIG. 1, cooling of the oil occurs as well as muffling of the sound created by discharge impulses. It will be appreciated that the discharge gas in muffler chamber 150 is cooler than ordinarily possible due to the discharge gas routing system of the present invention.

The combined discharge gas in muffler chamber 152, as indicated by line E in FIG. 4, is discharged into the inside of compressor housing 10 through a gas discharge outlet such as discharge gas passageway 162 communicating between muffler 152 and the inside of housing 10. Discharge passageway 162, in accord with one form of the present invention, comprises holes **162*a* in outboard bearing 74, 162*b* in cylinder block 84, 162*c* in main bearing 64, and 162*d* in muffler plate 90. A second discharge passageway 164 may also be provided in similar fashion, comprising holes 164*a*, 164*b*, 164*c*, and 164*d*. The combined discharge gas in chamber 152 is discharged through passageways 162 and 164 as indicated by directional arrows F and G, respectively. As can be seen from FIGS. 1 and 4, the discharge gas exiting passageways 162 and 164 is directed upwardly toward electric motor unit 20. In this way, the cooler discharge gases achieved by the gas routing system of the present invention provide more effective cooling of the stator windings 26**.

It has been discovered that for the best operation of the gas routing system of the present invention, discharge port 130 in the main bearing is preferably sized smaller than discharge port 140 in the outboard bearing in order to provide the necessary flow rate for gas to travel the longer distance through constricting passageway 160 before entering muffler chamber 152. For example, in an exemplary embodiment of the present invention, discharge port 130 is 0.181 inches in diameter while discharge port 140 is 0.312 inches in diameter. In such an embodiment, passageways 160, 162, and 164 are all approximately 0.343 inches in diameter.

It is appreciated that the advantages of the present invention over gas routing systems of the prior art, i.e., reduced noise levels and cooler operating conditions, are achieved by the unique structure of the present device wherein discharge gas is simultaneously discharged through both the main and outboard bearings, thereby initially reducing noise pulsations by dividing the mass flow. Noise levels are further reduced by additional stages of baffling provided by the muffling chambers and passageways of the present invention. Furthermore, expansion of the discharge gas in the upper muffler, recompression through a constricting gas passageway, and reexpansion into the lower muffler provides cooler discharge gas in the lower muffler for cooling of oil in the oil sump. Further recompression and routing of the gas through passageways prior to expansion into the housing directed at the stator windings provides improved cooling of the compressor motor. The advantages described herein result in quieter, more efficient operation of a rotary compressor.

It is appreciated that recompression of gas discharged into muffler chamber 150 during flow through constricting passageway 160 introduces some additional loading on the compressor motor. However, the resulting cooler discharge gas for cooling of the motor stator windings and oil results in a net improvement in motor efficiency and, consequently, improved compressor operating efficiency.

It will be appreciated that the foregoing is presented by way of illustration only, and not by way of any limitation, and that various alternatives and modifications may be made to the illustrated embodiment without departing from the spirit and scope of the invention.

What is claimed is:

1. A rotary compressor, comprising:

a cylinder block defining a cylinder;

a main bearing and an outboard bearing located on respective ends of said cylinder block and closing said cylinder at each of its opposite ends;

an eccentrically mounted piston means rotationally mounted in said cylinder;

a rotatable crankshaft operably supported by said main and said outboard bearings and drivingly connected to said piston means, the rotation of said piston means in said cylinder resulting in compressed gas within said cylinder;

means for discharging the compressed gas from within said cylinder, comprising a first discharge port in communication with and extending from said cylinder through said main bearing and a second discharge port in communication with and extending from said cylinder through said outboard bearing;

a first discharge muffler and a second discharge muffler mounted on said main and said outboard bearings, respectively, said first and said second discharge mufflers being in fluid communication with said first and said second discharge ports, respectively, whereby compressed gas discharged through said main bearing is expanded upon entry into said first muffler and compressed gas discharged through said outboard bearing is expanded upon entry into said second muffler;

constricting gas passage means communicating between said first and said second mufflers for allowing expanded gas in one of said first and said second mufflers to be constricted and reexpanded upon flowing from said one muffler to the other muffler; and gas discharge outlet means for providing fluid communication between said other muffler and the inside of said housing, said discharge outlet means comprising a plurality of discharge passages, each of said plurality of discharge passages being defined by substantially aligned holes through said main and said outboard bearings and said cylinder block.

2. The rotary compressor of claim 1 and further comprising:

a first discharge valve and a second discharge valve respectively mounted to said main and said outboard bearings, said first and said second discharge valves being in communication with said first and said second discharge ports, respectively.

3. The rotary compressor of claim 1 in which:

said first and said second discharge ports are axially aligned, whereby discharge of compressed gas through said first and second discharge port occurs simultaneously.

4. The rotary compressor of claim 1 in which:

said gas passage means comprises a passageway defined by substantially aligned holes through said main and said outboard bearings and said cylinder block.

5. The rotary compressor of claim 1 in which:

the discharge port operably associated with said one of said first and said second mufflers has a smaller cross-sectional area than that of the other discharge port, whereby the mass flow rate of the gas discharged into said one muffler is greater than that of the gas discharged into said other muffler.

6. The rotary compressor of claim 1 in which:

said first discharge muffler comprises a first muffler plate mounted on the axially outer end of said main bearing to define a first muffler chamber therebetween, and said second discharge muffler comprises a second muffler plate mounted on the axially outer end of said outboard bearing to define a second muffler chamber therebetween; and said gas discharge outlet means extends through the muffler plate associated with said one muffler.

7. The rotary compressor of claim 6 in which:

said muffler plate through which said gas discharge outlet extends includes a flange portion attached adjacent the axially outer surface of the bearing associated therewith, said flange portion having an aperture formed therein through which said gas discharge outlet means extends.

8. A hermetic rotary compressor, comprising:

a housing;

an electric motor operatively disposed within said housing and having a rotatable rotor;

a cylinder block disposed within said housing in axial alignment with said rotor, said cylinder block defining a cylinder therein;

a main bearing located on the end of said cylinder block adjacent to said motor, said main bearing closing the respective end of said cylinder;

an outboard bearing located on the end of said cylinder block opposite of said motor, said outboard bearing closing the respective end of said cylinder;

a crankshaft rotatably connected to said rotor and operably supported by said main and said outboard bearings;

piston means, comprising an eccentric roller within said cylinder and operably connected to said crankshaft, for compressing gas within said cylinder;

means for discharging compressed gas from within said cylinder axially outwardly in both axial directions, comprising a first discharge port communicating with said cylinder and extending through said main bearing, and a second discharge port communicating with said cylinder and extending through said outboard bearing;

a first muffler plate and a second muffler plate mounted on the distal ends of said main and said outboard bearings and defining a first muffler chamber and a second muffler chamber, respectively;

a gas passageway providing communication between said first and said second muffler chambers, comprising substantially aligned holes through said main and said outboard bearings and said cylinder block, and a plurality of gas discharge outlets, providing communication between one of said first and said second muffler chambers and the inside of said housing through said main and said outboard bearings and said cylinder block, said one muffler chamber being a discharge muffler and the other muffler chamber being an intermediate muffler, each of said plurality of discharge outlets being defined by substantially aligned holes through said main and said outboard bearings and said cylinder block.

9. The rotary compressor of claim 8 in which:

said first and said second discharge ports are axially aligned, whereby discharge of compressed gas through said first and second discharge ports occurs simultaneously.

10. A hermetically sealed rotary compressor, comprising:

a vertically disposed hermetically sealed cylindrical casing;

an electric motor unit mounted within said casing and including a rotatable rotor and a stator;

an oil sump located in a lower portion of said housing;

a cylinder block having a compression chamber defined therein;

an upper bearing mounted to the upper end of said cylinder block and defining an upper end wall of said chamber, said upper bearing having a upper discharge port extending therethrough;

a lower bearing mounted to the lower end of said cylinder block and defining a lower end wall of said compression chamber, said lower bearing having a lower discharge port extending therethrough;

a crankshaft drivingly connected to said rotor and operably supported by said upper and said lower bearings;

piston means drivingly connected to said crankshaft for compressing gas within said chamber;

an upper muffler mounted to the top of said upper bearing, said upper discharge port providing gaseous communication between said chamber and said upper muffler;

a lower muffler mounted to the bottom of said lower bearing and being in fluid contact with oil in said oil sump, said lower discharge port providing fluid communication between said chamber and said lower muffler;

constricting passage means communicating between said upper and said lower mufflers for constricting expanded discharge gas from said upper muffler and delivering it to said lower muffler for reexpansion therein; and discharge gas passage means, including a plurality of discharge passages communicating between said lower muffler and the inside of said housing through said upper and said lower bearings and said cylinder block, for constructing expanded discharge gas from said lower muffler and delivering it to the inside of said housing in an upward direction toward said motor for cooling thereof, said plurality of discharge passages being circumferentially spaced, whereby expanded discharge gas is delivered in an upward direction toward said motor at a plurality of spaced locations for more effective cooling thereof.

11. The rotary compressor of claim 10 in which:

said piston means comprises an eccentric roller and said upper and said lower discharge ports are axially aligned to achieve simultaneous discharge of compressed gas through said first and said second discharge ports.

12. The rotary compressor of claim 10 in which:

said constricting passage means comprises a passageway defined by substantially aligned holes through said upper and said lower bearings and said cylinder block.

13. The rotary compressor of claim 10 in which:

each of said plurality of discharge passages comprises a passageway defined by substantially aligned holes through said upper and said lower bearings and said cylinder block.

14. The rotary compressor of claim 8 in which:

each of said plurality of discharge outlets is further defined by an aperture formed in the muffler plate associated with the other of said first and said second muffler chambers.

15. The rotary compressor of claim 14 in which:

said muffler plate associated with the other of said first and second muffler chambers includes a flange portion attached adjacent the axially outer surface of the bearing associated therewith, said aperture being formed in said flange portion and being substantially aligned with said holes through said main and said outboard bearings and said cylinder block.

16. The rotary compressor of claim 8 in which:

the discharge port associated with said intermediate muffler has a smaller cross-sectional area than that of the discharge port associated with the discharge muffler, whereby the mass flow rate of the gas discharged into said intermediate muffler is greater than that of the gas discharged into the discharge muffler to enhance flow of gas from the intermediate muffler through said passageway into the discharge muffler before the gas therein is discharged through said plurality of discharge outlets.

17. The rotary compressor of claim 13 in which:

said upper muffler comprises a muffler plate attached to the top surface of said upper bearing to define an upper muffler chamber therebetween; and each of said plurality of discharge passages is further defined by an aperture in said muffler plate.

18. The rotary compressor of claim 17 in which:

said muffler plate includes a flange portion attached adjacent the top surface of said upper bearing, said aperture being formed in said flange portion in substantial alignment with said holes through said upper and lower bearings and said cylinder block.

* * * * *